US005107596A

United States Patent [19]

Snyder

[11] Patent Number: 5,107,596

[45] Date of Patent: Apr. 28, 1992

[54] ARCHERY PEEP SIGHTING SYSTEM

[75] Inventor: Peter W. Snyder, Hammond, La.

[73] Assignee: Joseph Regard, Covington, La. ; a part interest

[21] Appl. No.: 637,454

[22] Filed: Jan. 4, 1991

[51] Int. Cl.[5] ..... F41G 1/467; F41G 11/00

[52] U.S. Cl. ..... 33/265; 124/90

[58] Field of Search ..... 33/265; 124/87, 90, 124/91, 92

[56] References Cited

U.S. PATENT DOCUMENTS

| | | | |
|---|---|---|---|
| 3,703,770 | 11/1972 | Sofield | 33/265 |
| 3,859,733 | 1/1975 | Chesnick | 33/265 |
| 4,011,853 | 3/1977 | Fletcher | 124/87 |
| 4,539,970 | 9/1985 | Griz | 124/90 |
| 4,552,121 | 11/1985 | Treaster | 33/265 |
| 4,563,821 | 1/1986 | Saunders | 33/265 |
| 4,656,746 | 4/1987 | Gillespie | 33/265 |
| 4,833,786 | 5/1989 | Shores, Sr. | 33/265 |
| 4,895,129 | 1/1990 | Hedgpeth | 33/265 |
| 4,961,264 | 10/1990 | Topel | 33/265 |
| 4,965,938 | 10/1990 | Saunders | 33/265 |

*Primary Examiner*—Thomas B. Will

*Attorney, Agent, or Firm*—Joseph J. Regard

[57] ABSTRACT

A peep sight which is rotatably mounted to the string of the bow and includes a generally cylindrical body having a lateral bore therethrough, at least one sighting member angularly mounted on the outer wall of the body, and a weighted member displaced at an angle (generally between 40–90 degrees), also mounted on the outer wall of the body and emanating from the body in a position generally perpendicular relative the sighting member. The present invention provides a peep sighting system wherein the sight is always parallel with the horizon, notwithstanding the angle of the bow. Further, the sight is always in the correct alignment with the aiming eye of the user, unlike prior art methods, which were rigidly affixed to the string, and thereby often did not align appropriately with the user and target at critical times.

13 Claims, 2 Drawing Sheets

ARCHERY PEEP SIGHTING SYSTEM

BACKGROUND OF INVENTION

1. Field of Invention

The present invention relates to sighting apparatus for archery bows and the like, and in particular to a new and unique peep sighting system which is rotatably mounted to the string of the bow and includes a generally cylindrical body having an outer wall and a lateral bore therethrough, at least one circular sighting member mounted on the outer wall of the body, and a weighted member displaced at an angle, also mounted on the outer wall of the body and emanating from the body in a position generally perpendicular relative the sighting member.

The present invention provides a peep sighting system wherein the sight is always parallel with the horizon when the bowstring is pulled back into the firing position, notwithstanding the angle of the bow itself. Further, the sight is always in the correct alignment with the aiming eye of the user when pulled into the firing position, unlike prior art methods, which often required action on the part of the user to align the sight for use, complicating the aiming and firing of the bow at critical times.

2. Prior Art and General Background

While the prior art is replete with various designs for string-mounted peep sights, all of the prior art teaches sighting systems wherein the sight itself is in direct, rigid communication with the string, and in fact is tightly affixed to the string, unlike the present invention, which contemplates an engagement which allows rotation of the main body about the string, utilizing the string as the axis of rotation within its main body, lateral bore. The static, rigid means of affixing the sight to the string as contemplated by the below prior art is not desirable as it tends to lead to misalignment during pull-back, as the string tends to twist as one grasps and pulls back the bow string, removing the sighting bore from the line of sight.

A list of prior patents which may be of interest is presented below:

| U.S. Pat. No. | Patentee(s) | Issue Date |
|---|---|---|
| 3,199,502 | Stonecipher | 09/10/1965 |
| 3,410,644 | McLendon | 11/12/1968 |
| 3,600,814 | Smith | 09/24/1971 |
| 3,703,770 | Sofield | 11/28/1972 |
| 3,703,771 | Saunders | 11/28/1972 |
| 3,859,733 | Chesnick | 01/14/1975 |
| 3,942,507 | Opal | 03/09/1976 |
| 4,011,853 | Fletcher | 03/15/1977 |
| 4,563,821 | Saunders | 01/14/1986 |
| 4,625,422 | Carlson | 12/02/1986 |
| 4,656,994 | Jenks | 03/14/1987 |
| 4,833,786 | Shores, Sr. | 05/30/1989 |
| 4,848,306 | Treaster | 07/18/1989 |
| 4,860,458 | Ernstsen | 08/29/1989 |
| 4,895,129 | Hedgpeth | 01/23/1990 |
| 4,961,264 | Topel | 10/09/1990 |
| 4,965,938 | Saunders | 10/30/1990 |

U.S. Pat. Nos. 4,961,264, 4,848,306, 4,965,938, and 4,563,821 to Topel, Treaster and Saunders respectively, teach ridgedly-mounted sights to the string, but with various flexible cable members which are affixed to the string and bow in order to facilitate alignment of the string, thereby aligning the sight.

While these systems may have proved more useable than the other prior art as they facilitate alignment in spite of the twisting of the string, they are nonetheless fully distinguishable in form and function from the present invention, and prove complicated, unreliable, and even dangerous to use at times, as the aligning cable has been known to become dislodged at the bow, or break, and snapping directly back to the sight to which it is affixed, very likely striking the eye of the user, causing serious injury.

The other patents cited above are also distinguishable from the present invention, but nonetheless are worthy of citation, again teaching various peep sight designs rigidly affixed to the bowstring.

GENERAL, SUMMARY DISCUSSION OF THE INVENTION

The present invention overcomes the above prior art problems by providing a peep sighting system which is highly reliable, safe, relatively inexpensive, easy to install and use, and adaptable to almost any bow on the market.

The present invention comprises a peep sight for compound bows and the like which is rotatably mounted to the string of the bow, teaching an engagement which allows rotation of the generally cylindrical main body about the bowstring, allowing the bow string to form both the lateral support as well as the axis of rotation for the sight, including at least one circular sighting member angularly mounted on the outer wall of the main body, and a weighted member displaced at an angle from the outer wall of the main body (generally between 15–90 degrees), also mounted on the outer wall of the body and emanating from the body in a position generally perpendicular relative the sighting member.

Therefore, unlike the prior art, the present invention provides a peep sighting system wherein the sighting member is always parallel with the horizon when the bowstring is pulled back into the firing position, notwithstanding twisting of the bowstring. Further, the sight is always in the correct alignment with the aiming eye of the user, unlike prior art methods, which were often complicated and did not align at critical times due to twisting during pull back of the bowstring.

When the bow string is pulled back, the weighing member is configured to be drawn by gravity to the desired aiming position, rotating the sighting member to a position parallel the horizon, forming the desirable aiming position; twisting of the bow string during pull back has no effect as to the position of the sighting member, as the apparatus is not rigidly affixed to the string.

An alternative embodiment of the present invention provides sight members on both sides of the main body for left or right handed users; the unused sight may be trimmed off, if desired, or it may be left on with no appreciable effect as to performance.

The present system as designed can be used with almost any bow on the market; indeed, applicant knows of no bow which would not accept the present system, and is adaptable to both left as well as right handed users.

The preferred embodiment of the present invention may be injection molded or otherwise formed and may be constructed of polyurethane, NYLON TM, high density polyetheleyne, PVC, aluminum, or similar relatively light weight but strong materials.

The present invention, as designed, has not been shown to effect the trajectory of the arrows when launched; indeed, the improved, consistently correct aiming characteristics of the present system appears to indicate that accuracy is enhanced.

It is thus an object of the present invention to provide a peep sighting system which is able to be used with a variety of archery bows.

It is another object of the present invention to provide a peep sighting system which may be utilized by both left as well as right handed users.

It is another object of the present invention to provide a peep sighting system which is safe, inexpensive to manufacture, easy to install and use, and durable.

It is still another object of the present invention to provide a peep sighting system which is not rigidly affixed to the bow string, and which does not tend to misalign during pull back.

Lastly, it is an object of the present invention to provide a peep sighting system which is configured to be supported by the bow string, yet rotate about the bow string in such a fashion as to align the sighting member in parallel position relative the horizon, positioning the sighting member for aiming.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Figure 2:
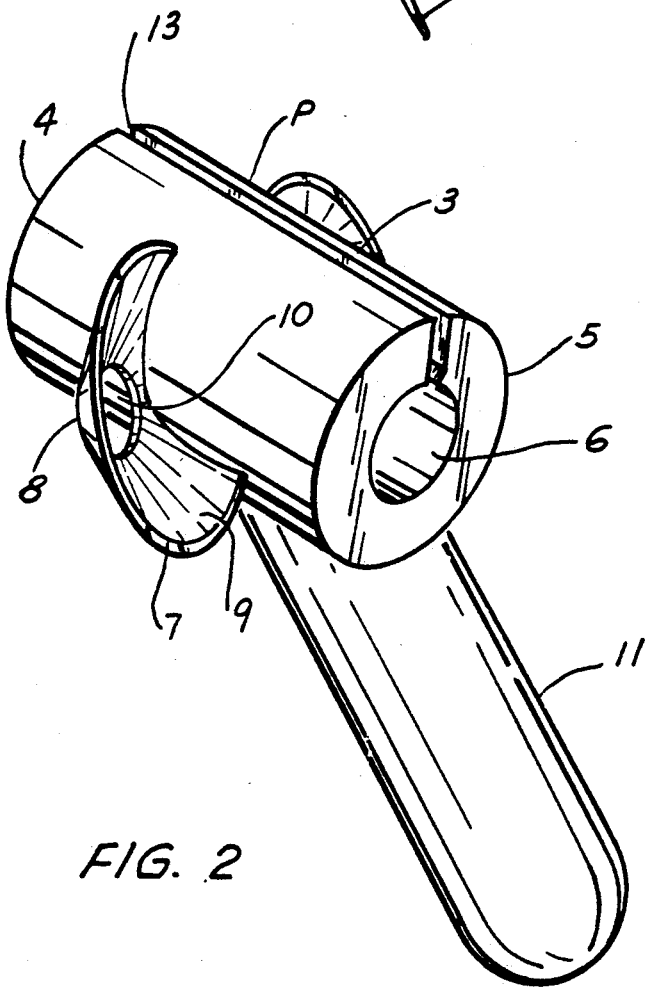
FIG. 2 is an isometric view of peep sighting apparatus of FIG. 1, illustrating placement and configuration of the main body, sighting member, and weighing member.

As can be seen in FIG. 2, the peep sighting system of the preferred, exemplary embodiment of the present invention, includes peep sight P which is comprised of a main body 3 of generally cylindrical configuration, having first 4 and second 5 ends and a lateral bore 6 therethrough of sufficient diameter as to allow a bow string to pass therethrough with additional tolerance so as to allow rotation of the main body about the bow string.

Emanating from the main body 3 is sighting member 7 and weighing member 11. Like main body 3, sighting member 7 is generally cylindrical in configuration, having first 8 and second 9 ends, and a lateral bore therethrough, which functions as a sight hole 10.

Figure 4:
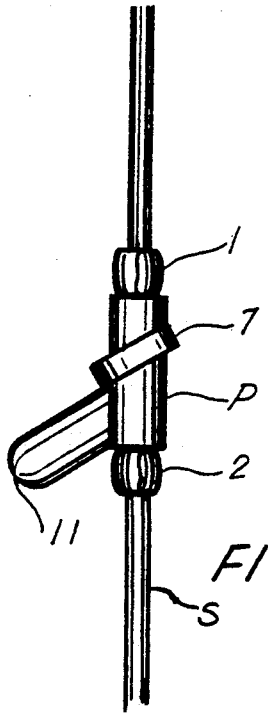
FIG. 4 is a side view of peep sighting system of FIG. 1, illustrating in close-up the relation of the peep sight apparatus with the bow string when the string is in the generally perpendicular, non-firing position.

As shown in FIG. 4, the main body 3 of the peep sight P of the present invention is configured to envelope the bow string S, with sufficient additional tolerance as to allow rotation of the main body about the string, with the string forming the axis of rotation. Grommets 1,2 are pinched about the string above and below the main body to prevent the sight from sliding up and down the string, and are clamped to the string below and above the sight, with sufficient tolerance as not to hamper rotation of the sight about the bowstring.

The sighting member 7 emanates from the outer side wall of the main body 3, situated in generally perpendicular fashion from the side wall, while the weighted member 11 is affixed to the outer side wall from the main body situated so as to be relatively perpendicular the sighting member 7. The faces 8,9 of the sighting member 7 and the weighted member 11 are angled relative the main body at generally the same angle, in the preferred embodiment, approximately 45 degrees.

Figure 1:
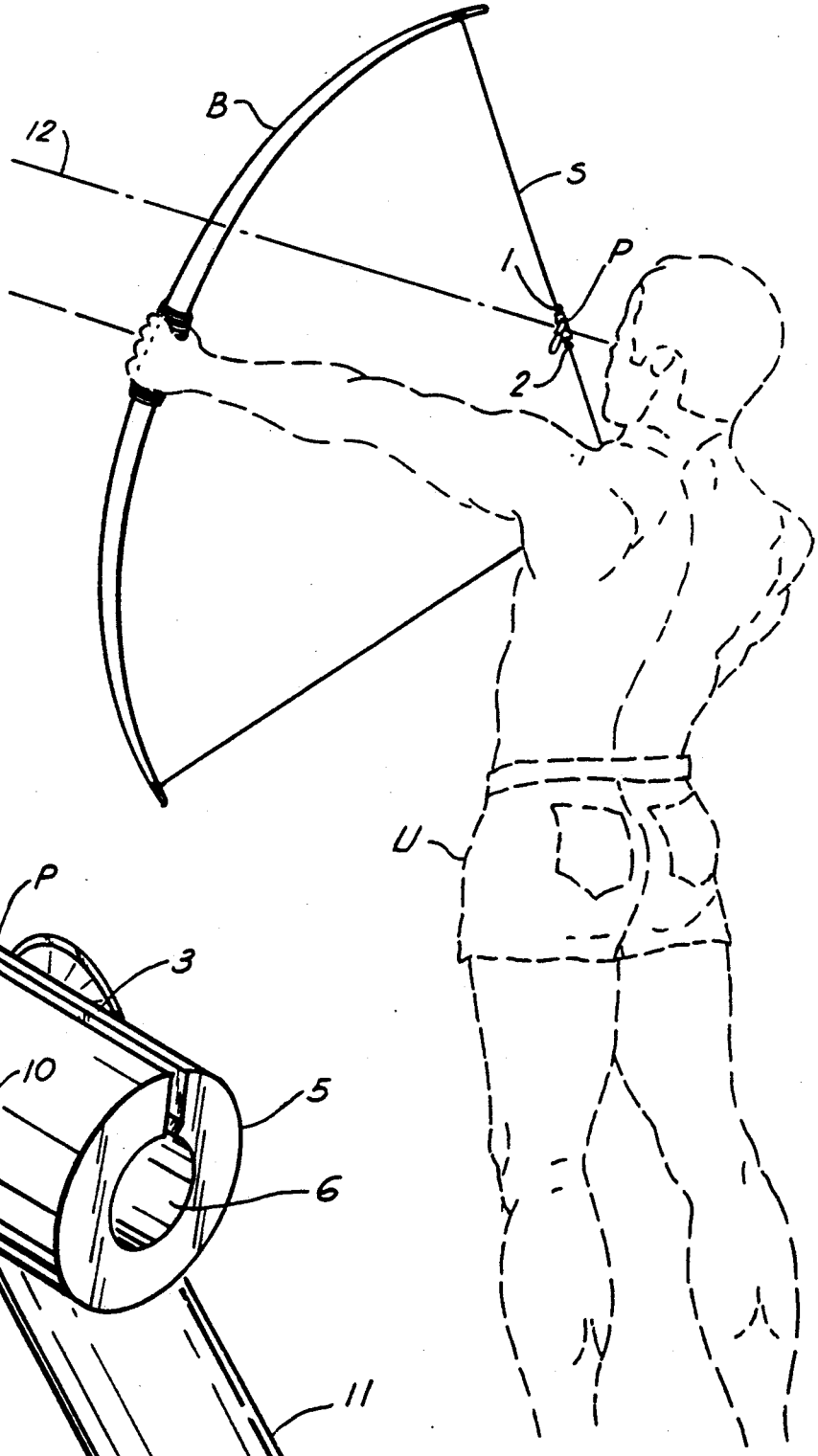
FIG. 1 is a side view of the preferred embodiment of the peep sighting system of the present invention, illustrating the placement of the sight on an archery bow and the positioning of the sight when the bow string is pulled in firing position, and further illustrating the user in phantom.
Figure 3:
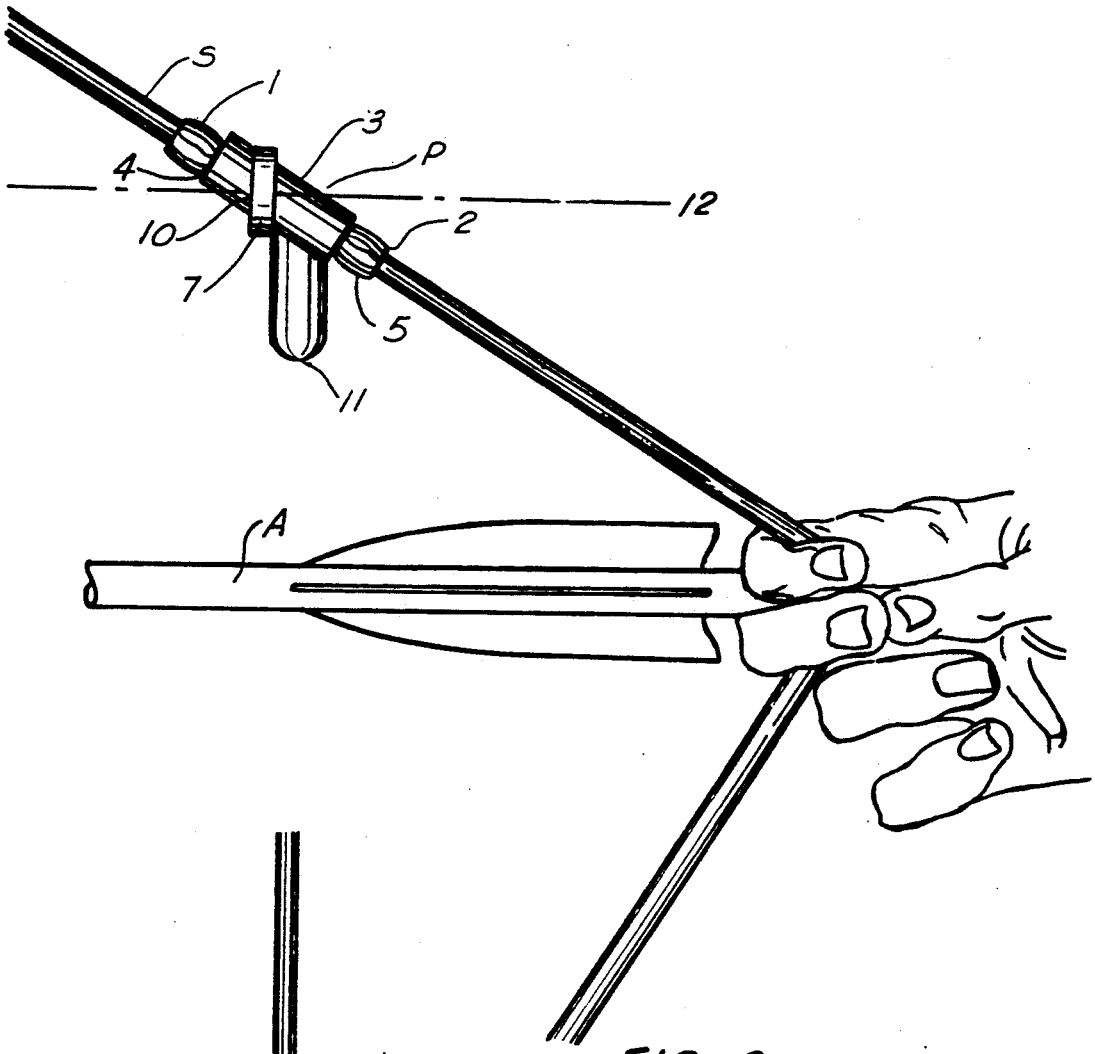
FIG. 3 is a side view of the preferred embodiment of the peep sighting system of FIG. 1, illustrating in close-up the horizontal alignment of the sighting member and its relationship with the bowstring when pulled back fully prior to firing.

As shown in FIGS. 1 and 3, the peep sight P is configured to adjust once the bowstring is pulled into the sighting position such that the sighting member 7 is generally horizontal due to the weighing action of the weighted member 11 being drawn by gravity toward the ground. Thus, when the bowstring S is pulled back in firing position, the weighted member 11 is relatively perpendicular the ground and the sight hole 10 of sighting member 7 is relatively horizontal relative the ground. As such, the line of sight 12 of the user U is able to be directed through the lateral bore of the sighting member 7.

The aiming of the present system is a generally similar procedure as that utilized by prior art peep sights, that is, the user merely sights through the lateral bore 10 or sight hole of the sighing member 7, aligning it with a forward sight at the target, and fires.

The preferred embodiment of the present invention may include a frustoconical, tapered sighting face surrounding the sight hole or lateral bore 10 of sighting member 7, as opposed to the flat, second face 9 as shown in FIG. 2. The frustoconical face may provide an easier means of aligning the sight hole with the target.

In order to install the present system, the bowstring may be removed and the string run through the lateral bore 6 of the main body 3, or, as shown in the preferred embodiment of FIG. 2, a slit 13, running from first 4 to the second 5 end of the main body, from the outer wall to the lateral bore 6, may be provided.

With the slit 13, the user merely places the bowstring against the outer wall over the slit area and pushes, forcing the bowstring through the slit and into the chamber. The slit should be such as to allow the slit walls to communicate in a "closed" position, but with sufficient force, the bowstring may be forced through the slit area. As further shown in FIG. 2, the slit 13 is configured at a generally forty-five degree (45) angle relative the side walls of lateral bore 6. This angled configuration is important in that the forty-five degree angled disposition of slit 13, combined with the slit walls being configured to communicate in a "closed" or contacting position as discussed above, prevents the site P from "popping off" the string when fired, even at high poundages. This is so because the string tension on release and completion of firing relative the inner side walls of lateral bore 6 is displaced at a generally ninety degree angle relative said side walls, whereas the forty five degree angle of slit 13, together with the "closed" slit walls, prevent direct exertion of the full force of the acceleration or braking of the string during the firing of the bow communicate with slit 13.

Once installed, the peep sight P will inadvertantly not come off. Thus, with the slit 13, the present invention may be installed without the prior art necessity of removing the bow string.

Approximate measures for the preferred embodiment of the present invention are as follows:

Main body—
- length—$\frac{3}{4}$ inch
- diameter—$\frac{1}{4}$ inch
- lateral borehole diameter—1/6 inch*

(* with bowstring of $\frac{1}{8}$ inch diameter)

Sighting member—
- length—1/6 inch
- diameter—$\frac{1}{3}$ inch
- lateral borehole diameter—$\frac{1}{8}$ inch
- angle of borehole relative main body—45 degrees Weighing member—
- length—$\frac{3}{4}$ inch
- diameter—$\frac{1}{4}$ inch
- angle relative main body—45 degrees The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A peep sighting apparatus for use in conjunction with an archery bow having a bowstring, comprising:

a main body having an outer side wall, a lateral bore having an inner side wall, and a slit having side walls in said main body, said slit configured in oblique fashion relative said inner side wall of said lateral bore, said slit communicating with said inner side wall of said lateral bore and said outer side wall, said side walls of said slit configured to communicate so as to form a smooth wall where said slit communicates with said inner side wall of said lateral bore;

a first sighting member in communication with said outer side wall of said main body;

self adjustment means for adjusting said sighting member into a generally horizontal aiming position when said bowstring is pulled back into firing position.

2. The peep sighting apparatus of claim 1, wherein said main body has first and second ends.

3. The peep sighting apparatus of claim 1, wherein said first sighting member has a sighting bore therethrough.

4. The peep sighting apparatus of claim 1, wherein said self adjustment means comprises a weighing member in communication with said outer side wall of said main body, said weighing member configured on said main body in perpendicular fashion relative said sighting member.

5. The peep sighting apparatus of claim 4, wherein said lateral bore is of sufficient diameter as to envelope said bowstring, said diameter of said lateral bore in excess of the diameter of said bowstring so as to allow said main body to freely rotate about said bowstring, said bowstring forming the axis of rotation said main body.

6. The peep sighting apparatus of claim 2, wherein said bowstring passes through said lateral bore of said main body.

7. The peep sighting apparatus of claim 6, wherein there is further included first and second grommets affixed to said bowstring below and above said main body for laterally positioning said main body on said bowstring.

8. The peep sighting apparatus of claim 1, wherein there is further included a second sighting member in communication with said outer side wall of said main body, said first sighting member positioned on said main body for a right handed user, said second sighting member positioned on said main body for a left handed user.

9. The peep sighting apparatus of claim 3, wherein the first sighting member has first and second faces, and wherein at least one of said faces is frustoconically tapered from wide to narrow diameter, said narrow diameter terminating at said sighting bore, forming a sighting face.

10. The peep sighting apparatus of claim 7, wherein said sighting member is positioned to the side of and removed from said bowstring.

11. The peep sighting apparatus of claim 2, wherein said main body has a lateral slit formed therein, said lateral slit formed from said outer side wall to said lateral bore and from said first end to said second end.

12. A method of sighting an archery bow having a bowstring, comprising the following step(s):

(a) providing a peep sighting apparatus, comprising:

a main body having first and second ends and an outer side wall, a lateral bore therethrough having an inner side wall, and a slit having side walls in said main body, said slit configured in oblique fashion relative said inner side wall of said lateral bore, said slit communicating with said inner side wall of said lateral bore and said outer side wall, said side walls of said slit configured to communicate so as to form a smooth wall where said slit communicates with said inner side wall of said lateral bore;

a first sighting member in communication with said outer side wall of said main body;

self adjustment means for adjusting said sighting member into a generally horizontal aiming position when said bowstring is pulled back into firing position;

(b) placing said bowstring through said lateral bore of said main body by pressing said bowstring against said slit in said main body, guiding said bowstring through said slit and in lateral position relative said lateral bore of said main body;

(c) slidingly adjusting said main body in lateral fashion along said bowstring to the appropriate sighting position for the user, thereby providing an adjusted main body;

(d) crimping a first grommet against said bowstring just below said first end of said adjusted main body to limit lateral migration along said string;

(e) crimping a second grommet against said bowstring just above said second end of said adjusted main body to limit lateral migration along said string;

(f) pulling said bowstring back to firing position;

(g) allowing said self adjustment means to align said first sight member to the generally horizontal;

(h) aiming at a target through said first sighting member;

(i) releasing said bowstring.

13. A method of installing a peep sighting apparatus to an archery bow having a bowstring, comprising the following steps:

(a) providing a peep sighting apparatus, comprising:

a main body having first and second ends and an outer side wall, a lateral bore therethrough having an inner side wall, and a slit having side walls in said main body, said slit configured in oblique fashion relative said inner side wall of said lateral bore, said slit communicating with said inner side wall of said lateral bore and said outer side wall, said side walls of said slit configured to communicate so as to form a smooth wall where said slit communicates with said inner side wall of said lateral bore;

a first sighting member in communication with said outer side wall of said main body;

self adjustment means for adjusting said sighting member into a generally horizontal aiming position when said bowstring is pulled back into firing position;

(b) placing said bowstring against said outer side wall of said main body over said slit, and pressing said bowstring through said slit, thereby placing said bowstring within said lateral bore of said main body;

(c) slidingly adjusting said main body in lateral fashion along said bowstring to the appropriate sighting position for the user, thereby providing an adjusted main body;

(d) crimping a first grommet against said bowstring just below said first end of said adjusted main body to limit lateral migration along said string;

(e) crimping a second grommet against said bowstring just above said second end of said adjusted main body to limit lateral migration along said string.

* * * * *